US009466917B2

(12) United States Patent
Ledgerwood et al.

(10) Patent No.: US 9,466,917 B2
(45) Date of Patent: Oct. 11, 2016

(54) HAZARDOUS LOCATION MULTI-PIN CONNECTORS

(71) Applicants: Adam Douglas Ledgerwood, Syracuse, NY (US); Kevin James Wolf, Tully, NY (US)

(72) Inventors: Adam Douglas Ledgerwood, Syracuse, NY (US); Kevin James Wolf, Tully, NY (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 120 days.

(21) Appl. No.: 14/305,414

(22) Filed: Jun. 16, 2014

(65) Prior Publication Data

US 2015/0364884 A1 Dec. 17, 2015

(51) Int. Cl.
*H01R 27/00* (2006.01)
*H01R 13/53* (2006.01)

(52) U.S. Cl.
CPC ..... *H01R 13/53* (2013.01); *H01R 27/00* (2013.01)

(58) Field of Classification Search
CPC ..... H01R 27/00; H01R 27/02; H01R 29/00; H01R 13/53
USPC ..... 439/217, 218
See application file for complete search history.

(56) References Cited

U.S. PATENT DOCUMENTS

| | | | |
|---|---|---|---|
| 3,399,374 | A | 8/1968 | Pauza et al. |
| 4,245,875 | A | 1/1981 | Shaffer et al. |
| 4,773,880 | A | 9/1988 | Sutton et al. |
| 4,950,169 | A | 8/1990 | Martin et al. |
| 5,018,985 | A | 5/1991 | Moore |
| 5,222,898 | A | 6/1993 | Fedder et al. |
| 5,354,219 | A | 10/1994 | Wanjura |
| 5,612,680 | A | 3/1997 | DeSanto |
| 6,908,324 | B1 | 6/2005 | Morley et al. |
| 7,513,038 | B2 | 4/2009 | Koh |
| 7,896,698 | B2 | 3/2011 | Trout et al. |
| 7,918,685 | B1 | 4/2011 | Kruckenberg |
| 8,070,514 | B2 | 12/2011 | Trout et al. |
| 2001/0039141 | A1 | 11/2001 | Katwala |

FOREIGN PATENT DOCUMENTS

| | | |
|---|---|---|
| GB | 2355348 | 4/2001 |
| RU | 132625 | 9/2013 |

OTHER PUBLICATIONS

Ushakova, E., International Search Report and Written Opinion of the International Searching Authority for PCT/US2015/035946, completed Sep. 25, 2015, mailed Oct. 8, 2015 pp. 1-7.

*Primary Examiner* — Khiem Nguyen
(74) *Attorney, Agent, or Firm* — King & Spalding LLP

(57) ABSTRACT

A system includes a first connector end and an electrical device having a second connector end. The first connector end has a number of electrical coupling features, where the electrical coupling features have a first subset of electrical coupling features and a second subset of electrical coupling features. The first electrical device has a second connector end detachably coupled to the first connector end, where the second connector end has a number of complementary electrical coupling features coupled to the electrical coupling features of the first connector end. The first subset of electrical coupling features can provide a first power signal to a first subset of complementary electrical coupling features of the second connector end.

20 Claims, 4 Drawing Sheets

HAZARDOUS LOCATION MULTI-PIN CONNECTORS

TECHNICAL FIELD

Embodiments of the invention relate generally to electrical connectors, and more particularly to systems, methods, and devices for multi-pin connectors.

BACKGROUND

Electrical connectors known in the art are configured to couple to a single device or a number of devices having the same voltage requirements. In other words, existing electrical connector ends of an electrical connector are captive to power one or more devices with a specific voltage requirement.

Further, hazardous locations require, under existing standards and/or regulations, a high level of protection. Such hazardous environments can include, but are not limited to, an airplane hanger, a tarmac, a fueling station, a chemical plant, an electric generating station, and an oil rig. In such a hazardous environment, various electrical devices having a variety of power requirements can be used. In a lighting context, a hazardous location can require a flashlight, a task light, a temporary light, and a flood light. Each of these lighting applications can have a different power requirement, and so under the current technology would each plug into separate electrical connectors to meet their individual power requirements.

SUMMARY

In general, in one aspect, the disclosure relates to a system. The system can include a first electrical connector end having a number of electrical coupling features, where the electrical coupling features have a first subset of electrical coupling features and a second subset of electrical coupling features. The system can also include a first electrical device having a second electrical connector end detachably coupled to the first electrical connector end, where the second electrical connector end has a number of complementary electrical coupling features coupled to the electrical coupling features of the first electrical connector end. The first subset of electrical coupling features can provide a first power signal to a first subset of complementary electrical coupling features of the second electrical connector end.

In another aspect, the disclosure can generally relate to an electrical connector end having a number of electrical coupling features. The electrical coupling features of the electrical connector end can include a first subset of electrical coupling features configured to deliver a first power signal to a first complementary electrical connector end, where the first complementary electrical connector end couples to the electrical coupling features. The electrical coupling features of the electrical connector end can also include a second subset of electrical coupling features configured to deliver a second power signal to a second complementary electrical connector end, where the second complementary electrical connector end couples to the electrical coupling features.

In yet another aspect, the disclosure can generally relate to an electrical connector. The electrical connector can include a first electrical connector end having a number of electrical coupling features, where the electrical coupling features includes a first subset of electrical coupling features and a second subset of electrical coupling features. The electrical connector can also include a second electrical connector end detachably coupled to the first connector end, where the second electrical connector end includes a number of complementary electrical coupling features coupled to the electrical coupling features of the first electrical connector end. The electrical coupling features can include a first subset of electrical coupling features that provides a first power signal to a first subset of complementary electrical coupling features of the second electrical connector end.

These and other aspects, objects, features, and embodiments will be apparent from the following description and the appended claims.

BRIEF DESCRIPTION OF THE DRAWINGS

The drawings illustrate only example embodiments of hazardous location multi-pin connectors and are therefore not to be considered limiting of its scope, as hazardous location multi-pin connectors may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
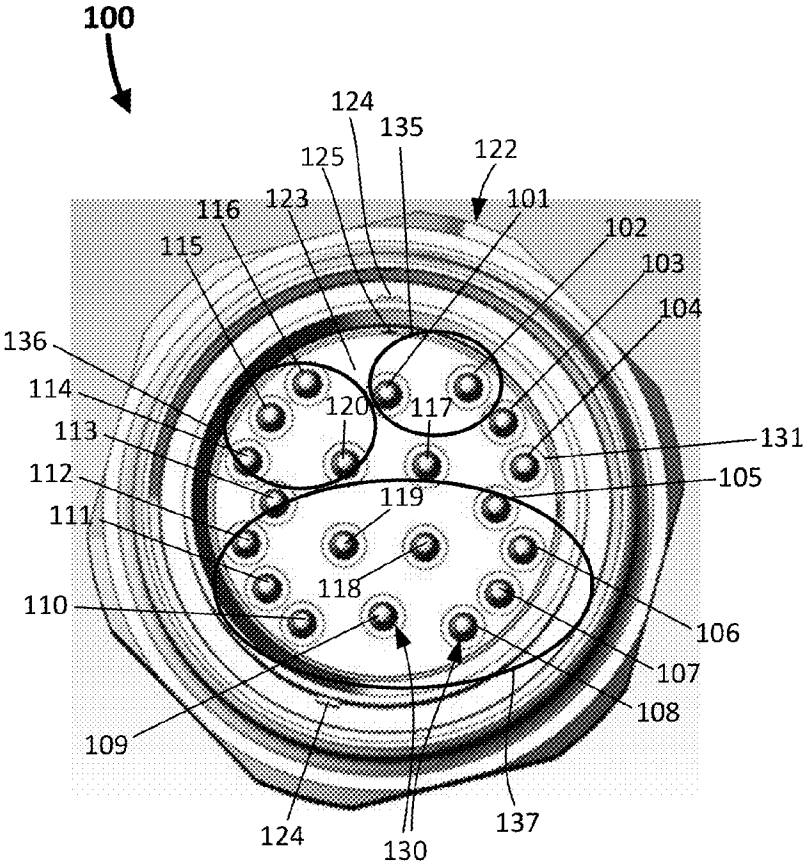
FIG. 1 shows an electrical connector end in accordance with certain example embodiments.

The example embodiments discussed herein are directed to systems, apparatuses, and methods of hazardous location multi-pin connectors. While the example hazardous location multi-pin connectors shown in the Figures and described herein are directed to lighting devices, example hazardous location multi-pin connectors can also be used with other devices aside from lighting devices, including but not limited to power tools, sensing devices, and motors. Thus, the examples of hazardous location multi-pin connectors described herein are not limited to use with lighting devices. An example electrical connector can include an electrical connector end that is coupled to a complementary electrical connector end.

Any example electrical connector, or portions (e.g., features) thereof, described herein can be made from a single piece (as from a mold). When an example electrical connector or portion thereof is made from a single piece, the single piece can be cut out, bent, stamped, and/or otherwise shaped to create certain features, elements, or other portions of a component. Alternatively, an example electrical connector (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, or other similar terms. Such terms are merely meant to distinguish various elements and/or features within a component or device and are not meant to limit the capability or function of that particular element and/or feature. For example, a feature described as a "coupling feature" can couple, secure, fasten, and/or perform other functions aside from merely coupling. In addition, each component and/or feature described herein can be made of one or more of a number of suitable materials, including but not limited to metal, rubber, and plastic.

A coupling feature (including a complementary coupling feature) as described herein can allow one or more components and/or portions of an electrical connector (e.g., a first connector end) to become mechanically and/or electrically coupled, directly or indirectly, to another portion (e.g., a second connector end) of the electrical connector. A coupling feature can include, but is not limited to, a conductor, a conductor receiver, portion of a hinge, an aperture, a recessed area, a protrusion, a slot, a spring clip, a tab, a detent, and mating threads. One portion of an example electrical connector can be coupled to another portion of an electrical connector by the direct use of one or more coupling features.

In addition, or in the alternative, a portion of an example electrical connector (e.g., an electrical connector end) can be coupled to another portion of the electrical connector (e.g., a complementary electrical connector end) using one or more independent devices that interact with one or more coupling features disposed on a component of the electrical connector. Examples of such devices can include, but are not limited to, a pin, a hinge, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

As described herein, a user can be any person that interacts with example hazardous location multi-pin connectors or a portion thereof. Examples of a user may include, but are not limited to, an engineer, an electrician, a maintenance technician, a mechanic, an operator, a consultant, a contractor, a homeowner, and a manufacturer's representative.

The hazardous location multi-pin connectors described herein can be physically placed in outdoor environments. In addition, or in the alternative, example hazardous location multi-pin connectors can be subject to extreme heat, extreme cold, moisture, humidity, high winds, dust, chemical corrosion, and other conditions that can cause wear on the hazardous location multi-pin connectors or portions thereof. In certain example embodiments, the hazardous location multi-pin connectors, including any portions thereof, are made of materials that are designed to maintain a long-term useful life and to perform when required without mechanical failure.

In addition, or in the alternative, example hazardous location multi-pin connectors can be located in hazardous and/or explosion-proof environments. In the latter case, the electrical connector can be an explosion-proof enclosure (also known as a flame-proof enclosure). An explosion-proof enclosure is an enclosure that is configured to contain an explosion that originates inside, or can propagate through, the enclosure. Further, the explosion-proof enclosure is configured to allow gases from inside the enclosure to escape across joints of the enclosure and cool as the gases exit the explosion-proof enclosure. The joints are also known as flame paths and exist where two surfaces (in this case, the two connector ends) meet and provide a path, from inside the explosion-proof enclosure to outside the explosion-proof enclosure, along which one or more gases may travel. A joint may be a mating of any two or more surfaces. Each surface may be any type of surface, including but not limited to a flat surface, a threaded surface, and a serrated surface.

In one or more example embodiments, an explosion-proof enclosure is subject to meeting certain standards and/or requirements. For example, NEMA sets standards with which an enclosure must comply in order to qualify as an explosion-proof enclosure. Specifically, NEMA Type 7, Type 8, Type 9, and Type 10 enclosures set standards with which an explosion-proof enclosure within a hazardous location must comply. For example, a NEMA Type 7 standard applies to enclosures constructed for indoor use in certain hazardous locations. Hazardous locations may be defined by one or more of a number of authorities, including but not limited to the National Electric Code (e.g., Class 1, Division I) and Underwriters' Laboratories, Inc. (UL) (e.g., UL 1203). For example, a Class 1 hazardous area under the National Electric Code is an area in which flammable gases or vapors may be present in the air in sufficient quantities to be explosive.

Examples of a hazardous location in which example embodiments can be used can include, but are not limited to, an airplane hanger, an airplane, a drilling rig (as for oil, gas, or water), a production rig (as for oil or gas), a refinery, a chemical plant, a power plant, a mining operation, and a steel mill.

Example embodiments of hazardous location multi-pin connectors will be described more fully hereinafter with reference to the accompanying drawings, in which example embodiments of hazardous location multi-pin connectors are shown. Hazardous location multi-pin connectors may, however, be embodied in many different forms and should not be construed as limited to the example embodiments set forth herein. Rather, these example embodiments are provided so that this disclosure will be thorough and complete, and will fully convey the scope of hazardous location multi-pin connectors to those of ordinary skill in the art. Like, but not necessarily the same, elements (also sometimes called modules) in the various figures are denoted by like reference numerals for consistency.

Terms such as "first," "second," "end," "distal," and "proximal" are used merely to distinguish one component (or part of a component or state of a component) from another. Such terms are not meant to denote a preference or a particular orientation. Also, the names given to various components described herein are descriptive of one embodiments and are not meant to be limiting in any way. Those skilled in the art will appreciate that a feature and/or component shown and/or described in one embodiment (e.g., in a figure) herein can be used in another embodiment (e.g., in any other figure) herein, even if not expressly shown and/or described in such other embodiment.

FIG. 1 shows one end 100 of an electrical connector (also called an electrical connector end 100) in accordance with certain example embodiments. In one or more embodiments, one or more of the components shown in FIG. 1 may be omitted, added, repeated, and/or substituted. Accordingly, embodiments of hazardous location multi-pin connectors should not be considered limited to the specific arrangements of components shown in FIG. 1.

Referring to FIG. 1, the electrical connector end 100 can include a shell 122, an insert 123, and a number of electrical coupling features 130. The shell 122 can be used to house some or all of the other components (e.g., the insert 123, the electrical coupling features 130) of the electrical connector end 100. The shell 122 can include one or more of a number of coupling features (e.g., mating threads, slots, detents) that can be used to connect the shell 122 to some other component (e.g., the shell of a complementary electrical connector end) of an electrical connector and/or to an enclosure (e.g., a junction box, a panel). The shell 122 can be made of one or more of a number of materials, including but not limited to metal and plastic. The shell 122 can be made of electrically conductive materials and/or electrically non-conductive materials.

The insert 123 can be disposed within the shell 122. One or more portions of the insert 123 can have one or more of a number of coupling features 125. Such coupling features 125 can be used to couple and/or align the insert 123 with one or more other components of the electrical connector end 100. In this example, the coupling feature 125 is a recessed area (e.g., a notch, a slot) disposed in the outer perimeter of the insert 123. In such a case, each coupling feature 125 can be used with a complementary coupling feature (e.g., a protrusion) disposed on the shell 122 to align the insert 123 with and/or mechanically couple the insert 123 to the shell 122.

The insert 123 can include one or more apertures that traverse through some or all of the insert 123. For example, there can be one or more apertures (hidden from view by the electrical coupling features 130, described below) disposed in various locations of the insert 123. In such a case, if there are multiple apertures, such apertures can be spaced in any of a number of ways and locations relative to each other. In certain example embodiments, one or more of the apertures can have an outer perimeter that is larger than the outer perimeter of the electrical coupling features 130. In such a case, there can be a gap 131 between an electrical coupling feature 130 and the insert 123.

The one or more apertures for the electrical coupling features 130 can be pre-formed when the insert 123 is created. In such a case, the electrical coupling features 130 can be post-inserted into the respective apertures of the insert 123. Alternatively, the insert 123 can be overmolded around the electrical coupling features 130. The insert 123 can be made of one or more of a number of materials, including but not limited to plastic, rubber, and ceramic. Such materials can be electrically conductive and/or electrically non-conductive.

In certain example embodiments, the one or more electrical coupling features 130 are made of one or more of a number of electrically conductive materials. Such materials can include, but are not limited to, copper and aluminum. Each electrical coupling feature 130 is configured to mechanically and electrically couple to, at one (e.g., distal) end (hidden from view), one or more electrical conductors, and to mechanically and electrically couple to, at the opposite (e.g., proximal) end, another portion (e.g., complementary electrical coupling features) of an electrical connector. Any of a number of configurations for the proximal end and the distal end of an electrical coupling feature 130 can exist and are known to those of ordinary skill in the art. The configuration of the proximal end and/or the distal end of one electrical coupling feature 130 of the electrical connector end 100 can be the same as or different than the configuration of the proximal end and/or the distal end of the remainder of electrical coupling features 130 of the electrical connector end 100.

The electrical coupling features 130 can take on one or more of a number of forms, shapes, and/or sizes. In this case, each of the electrical coupling features 130 is a cylindrical pin with a rounded end. There are 20 electrical coupling features in this example: electrical coupling feature 101, electrical coupling feature 102, electrical coupling feature 103, electrical coupling feature 104, electrical coupling feature 105, electrical coupling feature 106, electrical coupling feature 107, electrical coupling feature 108, electrical coupling feature 109, electrical coupling feature 110, electrical coupling feature 111, electrical coupling feature 112, electrical coupling feature 113, electrical coupling feature 114, electrical coupling feature 115, electrical coupling feature 116, electrical coupling feature 117, electrical coupling feature 118, electrical coupling feature 119, and electrical coupling feature 120.

Each of the electrical coupling features 130 in this case is shown to have substantially the same shape and size as the other electrical coupling features 130. In certain example embodiments, the shape and/or size of one electrical coupling feature 130 of an electrical connector end 100 can vary from the shape and/or size of one or more other electrical coupling features 130. This may occur, for example if varying amounts and/or types of current and/or voltage are delivered between the electrical coupling features 130.

In certain example embodiments, one or more of the electrical coupling features 130 are used to provide power (also called a power signal or power signals) to an electrical device that is coupled to an electrical connector end (such as the electrical connector end 300 shown in FIG. 3 below) having electrical coupling features that complement the electrical coupling features 130 of the electrical connector end 100. These one or more electrical coupling features 130 can be grouped as a subset of the electrical coupling features 130. A subset can include only one electrical coupling feature 130, all electrical coupling features 130, or any number of electrical coupling features 130 in between.

The example electrical connector end 100 can have multiple subsets of electrical coupling features 130, where each subset provides a different amount (e.g., 24 V, 120 V, 10 V, 277 V) and/or type (e.g., direct current (DC), alternating current (AC)) of power compared to the amount and/or type of power provided by the other subsets. Put another way, a subset of electrical coupling features 130 can be used to provide power to multiple electrical devices that each requires a specific type and amount of power. In such a case, a different power source is used to provide power to each subset.

As an example, as shown in FIG. 1, the electrical connector end 100 can have three subsets of electrical coupling features 130. Specifically, the electrical connector end 100 of FIG. 1 has subset 135, subset 136, and subset 137 of the electrical coupling features 130. Subset 135 has two electrical coupling features 130, which specifically includes electrical coupling feature 101 and electrical coupling feature 102. Subset 136 has four electrical coupling features 130, which includes electrical coupling feature 114, electrical coupling feature 115, electrical coupling feature 116, and electrical coupling feature 120.

Subset 137 has nine electrical coupling features 130, which includes electrical coupling feature 105, electrical coupling feature 106, electrical coupling feature 107, electrical coupling feature 108, electrical coupling feature 109, electrical coupling feature 110, electrical coupling feature 111, electrical coupling feature 118, and electrical coupling feature 119. In this case, none of the subsets overlap. In other words, none of the electrical coupling features 130 of the electrical connector end 100 belongs to more than one subset.

In certain example embodiments, a subset can supply a different amount and/or type of power compared to the amount and type of power provided by each of the other subsets. For example, subset 135 can provide 24 V DC to an electrical device using electrical coupling feature 101 as a positive leg and electrical coupling feature 102 as a negative leg. As another example, subset 136 can provide 277 V AC to an electrical device using electrical coupling feature 114 for the A-phase leg, electrical coupling feature 115 for the B-phase leg, electrical coupling feature 116 for the C-phase leg, and electrical coupling feature 120 for the neutral leg.

As yet another example, subset 137 can provide 12 V DC to an electrical device using electrical coupling feature 108 as a positive leg and electrical coupling feature 109 as a negative leg. The subset 137 can also provide 240 V AC to the electrical device using electrical coupling feature 105 for the A-phase leg, electrical coupling feature 106 for the B-phase leg, electrical coupling feature 107 for the C-phase leg, and electrical coupling feature 118 for the neutral leg. The subset 137 can also provide 110 V AC to the electrical device using electrical coupling feature 110 as the line voltage leg, electrical coupling feature 111 as the neutral leg, and electrical coupling feature 119 as the ground leg. Thus, in this example, the electrical device can use three distinct power inputs, all provided by subset 137.

In certain example embodiments, any electrical coupling features 130 of FIG. 1 that are not part of a subset are unused. Alternatively, an electrical coupling feature 130 of FIG. 1 that is not part of a subset can be used for other purposes aside from transferring electrical power to an electrical device. Examples of such other purposes can include, but are not limited to, the transfer of control signals and the transfer of data.

Figure 2:
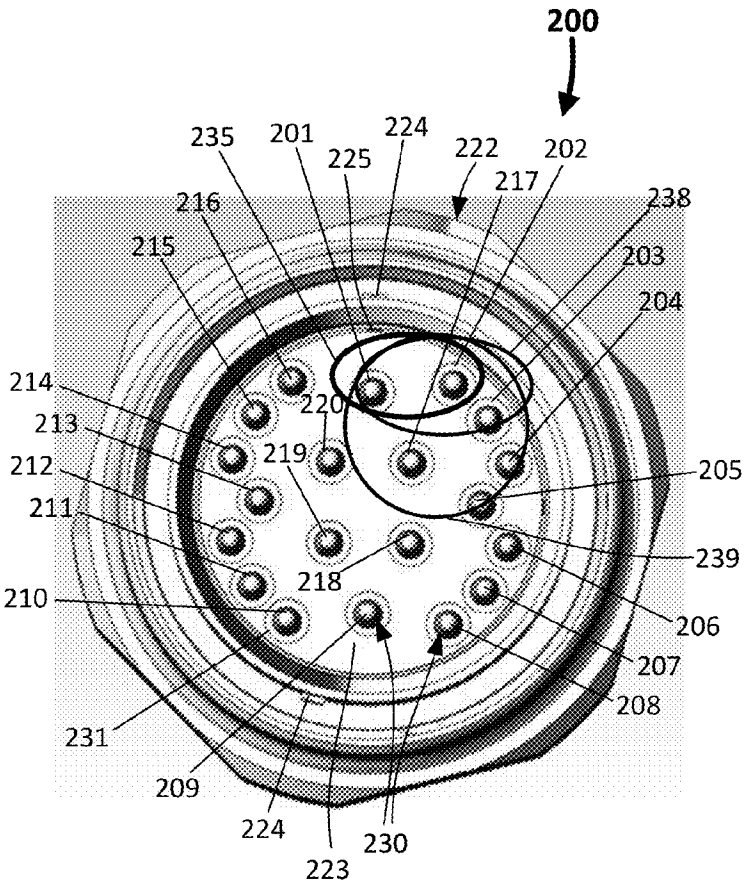
FIG. 2 shows another electrical connector end in accordance with certain example embodiments.

FIG. 2 shows another electrical connector end 200 in accordance with certain example embodiments. In one or more embodiments, one or more of the components shown in FIG. 2 may be omitted, added, repeated, and/or substituted. Accordingly, embodiments of electrical connector ends should not be considered limited to the specific arrangements of components shown in FIG. 2.

The electrical connector end 200 of FIG. 2 is substantially similar to the electrical connector end 100 of FIG. 1, except as described below. Any component described in FIG. 2 can apply to a corresponding component having a similar label in FIG. 1. In other words, the description for any component of FIG. 2 can be considered substantially the same as the corresponding component described with respect to FIG. 1. Further, if a component of FIG. 2 is described but not expressly shown or labeled in FIG. 2, a corresponding component shown and/or labeled in FIG. 2 can be inferred from the corresponding component of FIG. 1. The numbering scheme for the components in FIG. 2 herein parallel the numbering scheme for the components of FIG. 1 in that each component is a three digit number having the identical last two digits.

Referring to FIGS. 1 and 2, the shell 222, the insert 223, and the coupling features 224 of the electrical connector end 200 of FIG. 2 are substantially the same as the shell 222, the insert 223, and the coupling features 224 of FIG. 1. Further, the number, shape, size, and orientation of the electrical coupling features 230 of the electrical connector end 200 of FIG. 2 are substantially the same as the number, shape, size, and orientation of the electrical coupling features 130 of FIG. 1. The principal difference between the electrical connector end 200 of FIG. 2 and the electrical connector end 100 of FIG. 1 are the subsets of the electrical coupling features 230.

In this example, the electrical connector end 200 has three subsets of electrical coupling features 230: subset 235, subset 238, and subset 239. Subset 235 has two electrical coupling features 230, which specifically includes electrical coupling feature 201 and electrical coupling feature 202. Subset 238 has three electrical coupling features 230, which includes electrical coupling feature 201, electrical coupling feature 202, and electrical coupling feature 203. Subset 239 has three electrical coupling features 230, which includes electrical coupling feature 201, electrical coupling feature 202, electrical coupling feature 203, electrical coupling feature 204, electrical coupling feature 205, and electrical coupling feature 217.

In certain example embodiments, contrary to subset 135, subset 136, and subset 137 of FIG. 1, subset 235, subset 238, and subset 239 of FIG. 2 have at least one (in this case, two) common electrical coupling features 230. Specifically, electrical coupling feature 201 and electrical coupling feature 202 are included in each of subset 235, subset 238, and subset 239. While subset 235, subset 238, and subset 239 have one or more common electrical coupling features 230, none of these subsets have all the same electrical coupling features 230. In other words, none of the subsets in FIG. 2 are identical to the remainder of the subsets in FIG. 2.

Subset 235 has two electrical coupling features 230, which specifically includes electrical coupling feature 201 and electrical coupling feature 202. Subset 238 has three electrical coupling features 230, which includes electrical coupling feature 201, electrical coupling feature 202, and electrical coupling feature 203. Subset 239 has six electrical coupling features 230, which includes electrical coupling feature 201, electrical coupling feature 202, electrical coupling feature 203, electrical coupling feature 204, electrical coupling feature 205, and electrical coupling feature 217.

As described above, a subset can supply a different amount and/or type of power compared to the amount and type of power provided by each of the other subsets. For example, subset 235 can provide 110 V AC to an electrical device using electrical coupling feature 201 as an A-phase line voltage leg and electrical coupling feature 202 as a neutral leg. As another example, subset 238 can provide 110 V AC to an electrical device using electrical coupling feature 201 as an A-phase line voltage leg, electrical coupling feature 202 as a neutral leg, and electrical coupling feature 203 as a ground.

As yet another example, subset 239 can provide 110 V AC to an electrical device using electrical coupling feature 201 as an A-phase line voltage leg, electrical coupling feature 217 as a B-phase line voltage leg, electrical coupling feature 202 as a neutral leg, and electrical coupling feature 203 as a ground. Subset 239 can also provide 24 V DC to the electrical device using electrical coupling feature 204 as a positive leg and electrical coupling feature 205 as a negative leg. Thus, in this latter example, the electrical device can use two distinct power inputs, all provided by subset 239.

Figure 3:
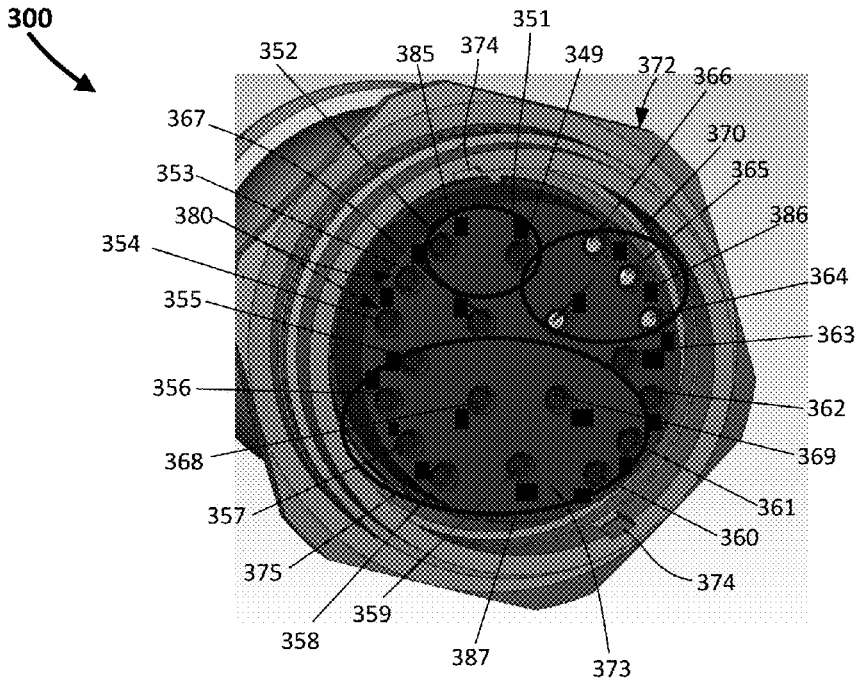
FIG. 3 shows a complementary electrical connector end in accordance with certain example embodiments.

FIG. 3 shows a complementary electrical connector end 300 in accordance with certain example embodiments. In one or more embodiments, one or more of the components shown in FIG. 3 may be omitted, added, repeated, and/or substituted. Accordingly, embodiments of complementary electrical connector ends should not be considered limited to the specific arrangements of components shown in FIG. 3.

Referring to FIGS. 1-3, the complementary electrical connector end 300 (or, more simply, the electrical connector end 300) of FIG. 3 is configured, based on the subsets (described below), to mechanically and electrically couple to the electrical connector end 100 of FIG. 1. With different subsets, the electrical connector end 300 can be coupled to the electrical connector end 200 of FIG. 2. The complementary electrical connector end 300 can include a shell 372 and an insert 373 that are substantially similar to the shell 122 and the insert 123 of the electrical connector end 100 of FIG. 1. Further, the complementary electrical connector end 300 can include one or more complementary coupling features 374 disposed along an inner surface of the shell 372. These complementary coupling features 374 can have a shape, size, orientation, and positioning on the shell 372 as to align with and couple to the coupling features 124 of the electrical connector end 100 of FIG. 1 and/or the coupling features 224 of the electrical connector end 200 of FIG. 2 when the complementary electrical connector end 300 is in one or more certain positions relative to the electrical connector end 100 of FIG. 1 and/or the electrical connector end 200 of FIG. 2.

The orientation of the complementary coupling features 374 on the shell 372 and the coupling features 124 on the shell 122 (and/or the coupling features 224 on the shell 222) can ensure that each of the electrical coupling features 130 of the electrical connector end 100 (and/or the electrical coupling features 230 of the electrical connector end 200) are properly aligned with the appropriate complementary electrical coupling features 380 (described below) of the complementary electrical connector end 300 when the electrical connector end 300 is coupled to the electrical connector end 100 and/or the electrical connector end 200.

The insert 373 can be disposed within the shell 372. One or more portions of the insert 373 can have one or more of a number of coupling features 375. Such coupling features 375 can be used to couple and/or align the insert 373 with one or more other components of the electrical connector end 300. In this example, the coupling features 375 is a recessed area (e.g., a notch, a slot) disposed in the outer perimeter of the insert 373. In such a case, each coupling feature 375 can be used with a complementary coupling feature (e.g., a protrusion) disposed on the shell 372 to align the insert 373 with and/or mechanically couple the insert 373 to the shell 372.

The insert 373 can include one or more apertures 349 that traverse through some or all of the insert 373. For example, as shown in FIG. 3, there can be multiple apertures 349 disposed in various locations of the insert 373. In such a case, if there are multiple apertures 349, such apertures 349 can be spaced in any of a number of ways and locations relative to each other. In certain example embodiments, one or more of the apertures 349 can have an outer perimeter that is slightly larger than the outer perimeter of the electrical coupling features 380, which are disposed along some or all of the wall inside the insert 373 that forms the aperture 349.

The one or more apertures 349 for the complementary electrical coupling features 380 can be pre-formed when the insert 373 is created. In such a case, the complementary electrical coupling features 380 can be post-inserted into the respective apertures 349 of the insert 373. Alternatively, the insert 373 can be overmolded around the complementary electrical coupling features 380. The insert 373 can be made of one or more of a number of materials, including but not limited to plastic, rubber, and ceramic. Such materials can be electrically conductive and/or electrically non-conductive.

In certain example embodiments, the one or more complementary electrical coupling features 380 are made of one or more of a number of electrically conductive materials. Such materials can include, but are not limited to, copper and aluminum. Each complementary electrical coupling features 380 is configured to mechanically and electrically couple to, at one (e.g., distal) end (hidden from view), one or more electrical conductors, and to mechanically and electrically couple to, at the opposite (e.g., proximal) end, another portion (e.g., electrical coupling features 130) of an electrical connector. Any of a number of configurations for the proximal end and the distal end of an complementary electrical coupling features 380 can exist and are known to those of ordinary skill in the art. The configuration of the proximal end and/or the distal end of one complementary electrical coupling feature 380 of the electrical connector end 300 can be the same as or different than the configuration of the proximal end and/or the distal end of the remainder of complementary electrical coupling features 380 of the electrical connector end 300.

The complementary electrical coupling features 380 can take on one or more of a number of forms, shapes, and/or sizes. In this case, each of the complementary electrical coupling features 380 includes electrically conductive material lines some or all of the wall that forms the aperture 349 of the complementary electrical coupling feature 380. The aperture 349, lined with the electrically conductive material of the complementary electrical coupling features 380, can have a shape and size that is substantially the same as, or slightly smaller than, the shape and size of the electrical coupling feature 130 that is inserted into and couples with the complementary electrical coupling feature 380. Thus, when an electrical coupling feature 130 is inserted into the aperture 349 of a complementary electrical coupling features 380, the electrical coupling feature 130 and the complementary electrical coupling features 380 become electrically coupled to each other.

There are 20 complementary electrical coupling features 380 in this example: complementary electrical coupling features 351, complementary electrical coupling features 352, complementary electrical coupling features 353, complementary electrical coupling features 354, complementary electrical coupling features 355, complementary electrical coupling features 356, complementary electrical coupling features 357, complementary electrical coupling features 358, complementary electrical coupling features 359, complementary electrical coupling features 360, complementary electrical coupling features 361, complementary electrical coupling features 362, complementary electrical coupling features 363, complementary electrical coupling features 364, complementary electrical coupling features 365, complementary electrical coupling features 366, complementary electrical coupling features 367, complementary electrical coupling features 368, complementary electrical coupling features 369, and complementary electrical coupling features 370.

Each of the complementary electrical coupling features 380 in this case is shown to have substantially the same shape and size as the other complementary electrical coupling features 380. In certain example embodiments, the shape and/or size of one complementary electrical coupling features 380 of an electrical connector end 300 can vary from the shape and/or size of one or more other complementary electrical coupling features 380. This may occur, for example if varying amounts and/or types of current and/or voltage are delivered between the complementary electrical coupling features 380. In certain example embodiments, the shape, size, orientation, and positioning of the complementary electrical coupling features 380 of the electrical connector end 300 form a mirror image with the electrical coupling features (e.g., electrical coupling features 130) of the electrical connector end (e.g., electrical connector end 100) to which the electrical connector end 300 couples.

As with the electrical connector end 100, one or more of the complementary electrical coupling features 380 can be used to receive power (also called a power signal or power signals) for an electrical device from an electrical connector end (such as the electrical connector end 100) having electrical coupling features that complement the complementary electrical coupling features 380 of the electrical connector end 300. These one or more complementary electrical coupling features 380 can be grouped as a subset of the complementary electrical coupling features 380. A subset can include only one complementary electrical coupling feature 380, all complementary electrical coupling features 380, or any number of complementary electrical coupling features 380 in between.

The example electrical connector end 300 can have multiple subsets of complementary electrical coupling features 380, where each subset receives a different amount (e.g., 24 V, 120 V, 10 V, 277 V) and/or type (e.g., direct current (DC), alternating current (AC)) of power compared to the amount and/or type of power received by the other subsets. Put another way, a subset of complementary electrical coupling features 380 can be used to receive a specific type and amount of power for one or more electrical devices.

As an example, as shown in FIG. 3, the electrical connector end 300 can have three subsets of complementary electrical coupling features 380. Specifically, the electrical connector end 300 of FIG. 3 has subset 385, subset 386, and subset 387 of the complementary electrical coupling features 380. In this case, subset 385, subset 386, and subset 387 of the electrical connector end 300 of FIG. 3 are each the mirror image of subset 135, subset 136, and subset 137, respectively, of the electrical connector end 100 of FIG. 1.

Specifically, subset 385 has two complementary electrical coupling features 380, which specifically includes complementary electrical coupling feature 351 and complementary electrical coupling feature 352. Subset 386 has four complementary electrical coupling features 380, which includes complementary electrical coupling feature 364, complementary electrical coupling feature 365, complementary electrical coupling feature 366, and complementary electrical coupling feature 370. Subset 387 has nine complementary electrical coupling features 380, which includes complementary electrical coupling feature 355, complementary electrical coupling feature 356, complementary electrical coupling feature 357, complementary electrical coupling feature 358, complementary electrical coupling feature 359, complementary electrical coupling feature 360, complementary electrical coupling feature 361, complementary electrical coupling feature 368, and complementary electrical coupling feature 369. As in FIG. 1, in this case, none of the subsets overlap. In other words, none of the complementary electrical coupling features 380 of the electrical connector end 300 belongs to more than one subset.

In certain example embodiments, a subset of the electrical connector end 300 can receive a different amount and/or type of power compared to the amount and type of power received by each of the other subsets. More specifically, a subset of the electrical connector end 300 can be configured to receive the amount and type of power delivered by the corresponding subset of the electrical connector end 100. Thus, subset 385 of the electrical connector end 300 is configured to couple to and receive power from the subset 135 of the electrical connector end 100 described above. Further, subset 386 of the electrical connector end 300 is configured to couple to and receive power from the subset 136 of the electrical connector end 100 described above. Also, subset 387 of the electrical connector end 300 is configured to couple to and receive power from the subset 137 of the electrical connector end 100 described above.

The electrical connector end 300 can be part of an electrical device, regardless of whether the electrical connector end 300 is directly (e.g., within the same housing or enclosure) or indirectly coupled to the electrical device. The electrical connector end 300 of the electrical device uses power delivered by one of the subsets of the electrical connector end 100 (and, thus, received by the corresponding subset of the electrical connector end 300). In certain example embodiments, only one subset of the electrical connector end 300 is electrically coupled to the corresponding electrical device. In other words, the complementary electrical coupling features 380 of the subsets that receive the type and/or amount of power not used by the electrical device are not electrically coupled (but are mechanically coupled) to the electrical device. Specific examples of this are described below with respect to FIGS. 5-8.

In certain example embodiments, any complementary electrical coupling features 380 of FIG. 3 that are not part of a subset are unused. Alternatively, a complementary electrical coupling feature 380 of FIG. 3 that is not part of a subset can be used for other purposes aside from transferring electrical power to an electrical device. Examples of such other purposes can include, but are not limited to, the transfer of control signals and the transfer of data.

In certain example embodiments, the electrical connector end 300 is coupled to the electrical connector end 100 in a hazardous environment. In such a case, the electrical connector (which can include the electrical connector end 100 coupled to the electrical connector end 300) can comply with applicable standards for hazardous locations. When an example electrical connector complies with applicable standards for hazardous locations, the example electrical connector is rated for use in a hazardous environment.

In other example embodiments, when the electrical connector end 300 is coupled to the electrical connector end 100, the shell 372 and the shell 122 form a flame path therebetween. In such a case, if one of the electrical enclosure ends (e.g., electrical enclosure end 100) is mounted within an aperture of an explosion-proof enclosure, coupling the complementary electrical connector end (e.g., electrical enclosure end 300) maintains the integrity of the explosion-proof enclosure so that the explosion-proof enclosure continues to comply with applicable standards.

Figure 4:
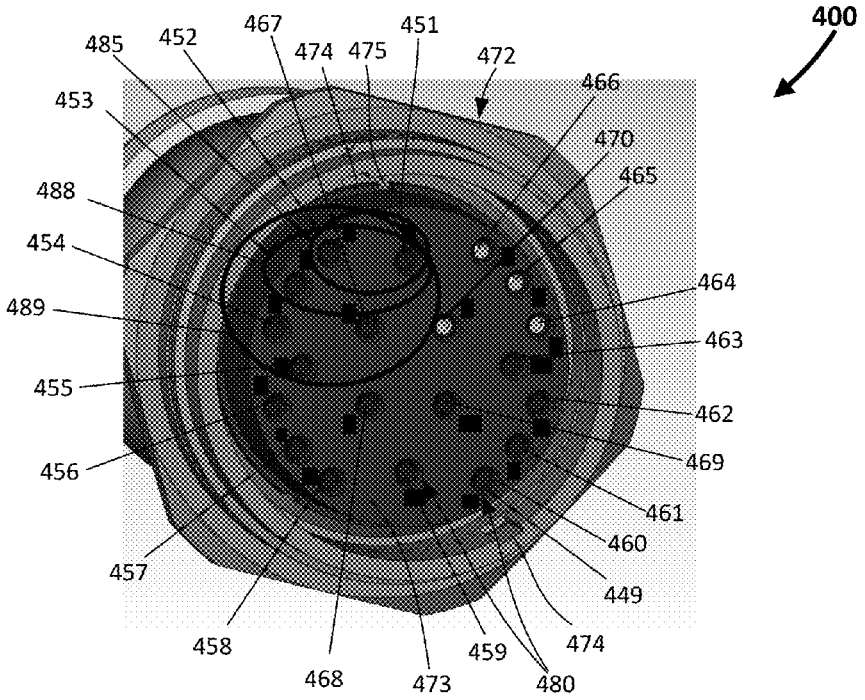
FIG. 4 shows another complementary electrical connector end in accordance with certain example embodiments.

FIG. 4 shows another complementary electrical connector end 400 in accordance with certain example embodiments.

In one or more embodiments, one or more of the components shown in FIG. 4 may be omitted, added, repeated, and/or substituted. Accordingly, embodiments of electrical connector ends should not be considered limited to the specific arrangements of components shown in FIG. 4.

The electrical connector end 400 of FIG. 4 is substantially similar to the electrical connector end 300 of FIG. 3, except as described below. Any component described in FIG. 4 can apply to a corresponding component having a similar label in FIG. 3. In other words, the description for any component of FIG. 4 can be considered substantially the same as the corresponding component described with respect to FIG. 3. Further, if a component of FIG. 4 is described but not expressly shown or labeled in FIG. 4, a corresponding component shown and/or labeled in FIG. 4 can be inferred from the corresponding component of FIG. 3. The numbering scheme for the components in FIG. 4 herein parallel the numbering scheme for the components of FIG. 3 in that each component is a three digit number having the identical last two digits.

Referring to FIGS. 1-4, the complementary electrical connector end 400 (or, more simply, the electrical connector end 400) of FIG. 4 is configured, based on the subsets (described below), to mechanically and electrically couple to the electrical connector end 200 of FIG. 2. With different subsets, as with the subsets described above with respect to FIG. 3, the electrical connector end 400 can be coupled to the electrical connector end 100 of FIG. 1. The shell 472, the insert 473, and the coupling features 474 of the electrical connector end 400 of FIG. 4 are substantially the same as the shell 372, the insert 373, and the coupling features 374 of FIG. 3. Further, the number, shape, size, and orientation of the complementary electrical coupling features 480 of the electrical connector end 400 of FIG. 4 are substantially the same as the number, shape, size, and orientation of the complementary electrical coupling features 380 of FIG. 3. The principal difference between the electrical connector end 400 of FIG. 4 and the electrical connector end 300 of FIG. 3 are the subsets of the complementary electrical coupling features 480.

As with the electrical connector end 300, one or more of the complementary electrical coupling features 480 of the electrical connector end 400 can be used to receive power (also called a power signal or power signals) for an electrical device from an electrical connector end (such as the electrical connector end 200) having electrical coupling features that complement the complementary electrical coupling features 480 of the electrical connector end 400. These one or more complementary electrical coupling features 480 can be grouped as a subset of the complementary electrical coupling features 480. A subset can include only one complementary electrical coupling feature 480, all complementary electrical coupling features 480, or any number of complementary electrical coupling features 480 in between.

In this example, the electrical connector end 400 has three subsets of complementary electrical coupling features 480: subset 485, subset 488, and subset 489. Subset 485 has two complementary electrical coupling features 480, which specifically includes complementary electrical coupling feature 451 and complementary electrical coupling feature 452. Subset 488 has three complementary electrical coupling features 480, which includes complementary electrical coupling feature 451, complementary electrical coupling feature 452, and complementary electrical coupling feature 453. Subset 489 has six complementary electrical coupling features 480, which includes complementary electrical coupling feature 451, complementary electrical coupling feature 452, complementary electrical coupling feature 453, complementary electrical coupling feature 454, complementary electrical coupling feature 455, and complementary electrical coupling feature 467.

In certain example embodiments, contrary to subset 385, subset 386, and subset 387 of FIG. 3, subset 485, subset 488, and subset 489 of FIG. 4 have at least one (in this case, two) common complementary electrical coupling features 480. Specifically, complementary electrical coupling feature 451 and electrical coupling feature 452 are included in each of subset 485, subset 488, and subset 489. While subset 485, subset 488, and subset 489 have one or more common complementary electrical coupling features 480, none of these subsets have all the same complementary electrical coupling features 480. In other words, none of the subsets in FIG. 4 are identical to the remainder of the subsets in FIG. 4.

In certain example embodiments, a subset of the electrical connector end 400 can receive a different amount and/or type of power compared to the amount and type of power received by each of the other subsets. More specifically, a subset of the electrical connector end 400 can be configured to receive the amount and type of power delivered by the corresponding subset of the electrical connector end 200. Thus, subset 485 of the electrical connector end 400 is configured to couple to and receive power from the subset 235 of the electrical connector end 200 described above. Further, subset 488 of the electrical connector end 400 is configured to couple to and receive power from the subset 238 of the electrical connector end 200 described above. Also, subset 489 of the electrical connector end 400 is configured to couple to and receive power from the subset 239 of the electrical connector end 200 described above.

The electrical connector end 400 can be part of an electrical device, regardless of whether the electrical connector end 400 is directly (e.g., within the same housing or enclosure) or indirectly coupled to the electrical device. The electrical connector end 400 of the electrical device uses power delivered by one of the subsets of the electrical connector end 200 (and, thus, received by the corresponding subset of the electrical connector end 400). In certain example embodiments, only one subset of the electrical connector end 400 is electrically coupled to the corresponding electrical device. In other words, the complementary electrical coupling features 480 of the subsets that receive the type and/or amount of power not used by the electrical device are not electrically coupled (but are mechanically coupled) to the electrical device. As stated above, specific examples of this are described below with respect to FIGS. 5-8.

In certain example embodiments, any complementary electrical coupling features 480 of FIG. 4 that are not part of a subset are unused. Alternatively, a complementary electrical coupling feature 480 of FIG. 4 that is not part of a subset can be used for other purposes aside from transferring electrical power to an electrical device. Examples of such other purposes can include, but are not limited to, the transfer of control signals and the transfer of data.

In certain example embodiments, the electrical connector end 400 is coupled to the electrical connector end 200 in a hazardous environment. In such a case, the electrical connector (which can include the electrical connector end 200 coupled to the electrical connector end 400) can comply with applicable standards for hazardous locations. When an example electrical connector complies with applicable standards for hazardous locations, the example electrical connector is rated for use in a hazardous environment.

In other example embodiments, when the electrical connector end 400 is coupled to the electrical connector end 200, the shell 472 and the shell 222 form a flame path therebetween. In such a case, if one of the electrical enclosure ends (e.g., electrical enclosure end 200) is mounted within an aperture of an explosion-proof enclosure, coupling the complementary electrical connector end (e.g., electrical enclosure end 400) maintains the integrity of the explosion-proof enclosure so that the explosion-proof enclosure continues to comply with applicable standards.

Figure 5:
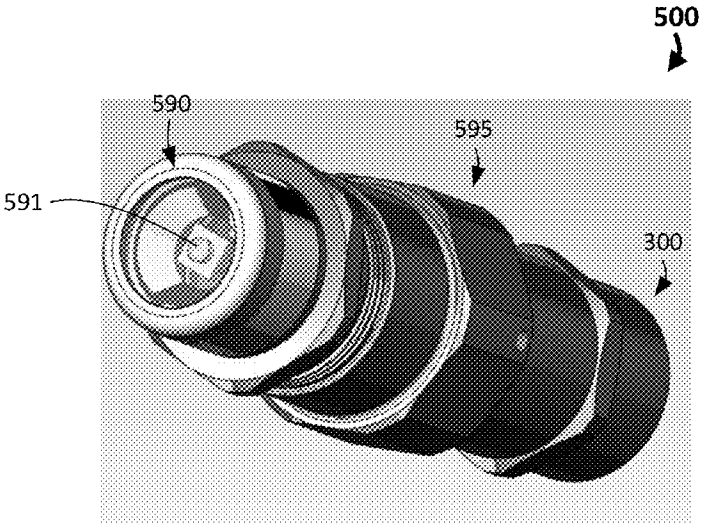
FIG. 5 shows an electrical device having a complementary electrical connector end in accordance with certain example embodiments.
Figure 6B:
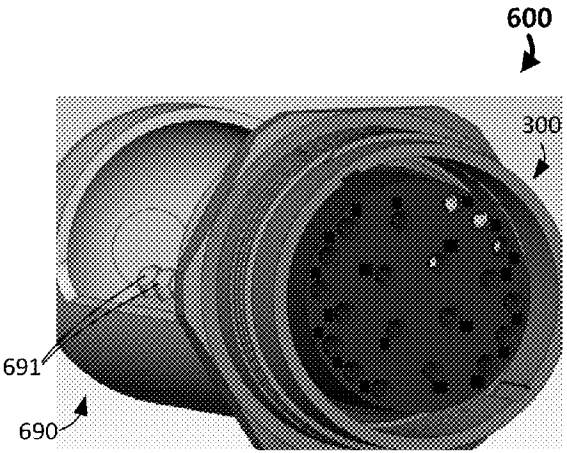
FIGS. 6A and 6B show another electrical device having a complementary electrical connector end in accordance with certain example embodiments.
Figure 6A:
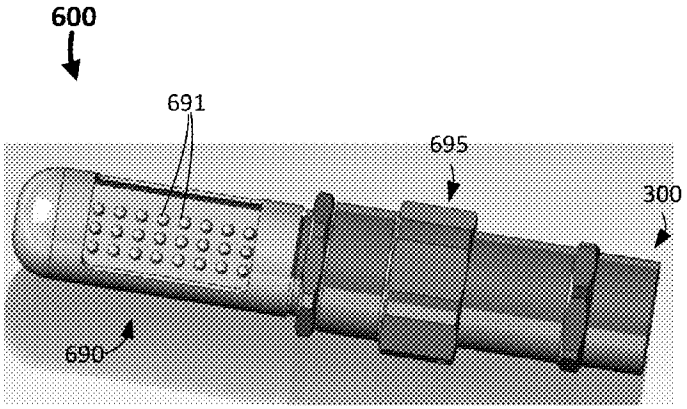
Figure 8:
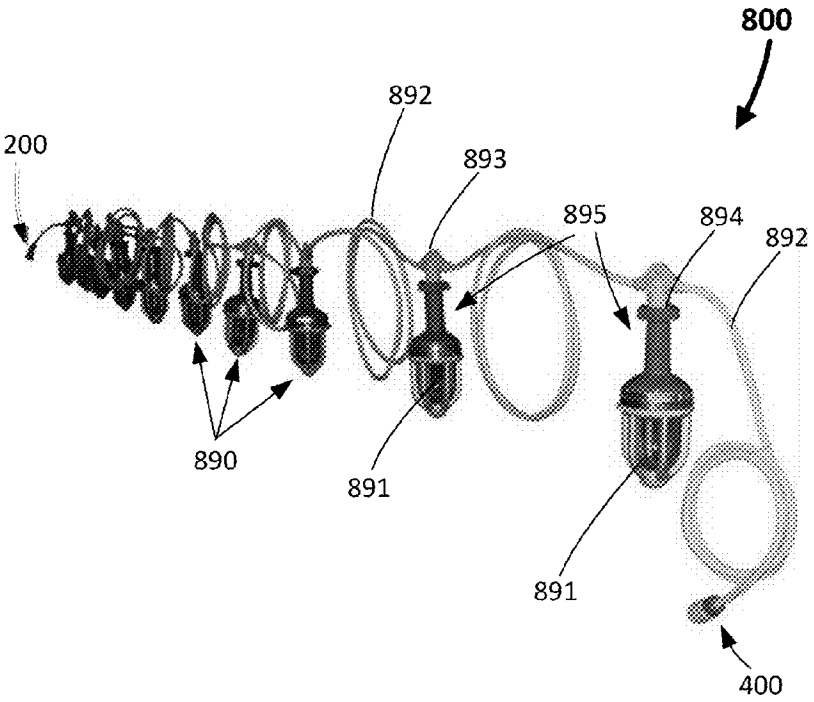
FIG. 8 shows still another electrical device having a complementary electrical connector end in accordance with certain example embodiments.
Figure 7:
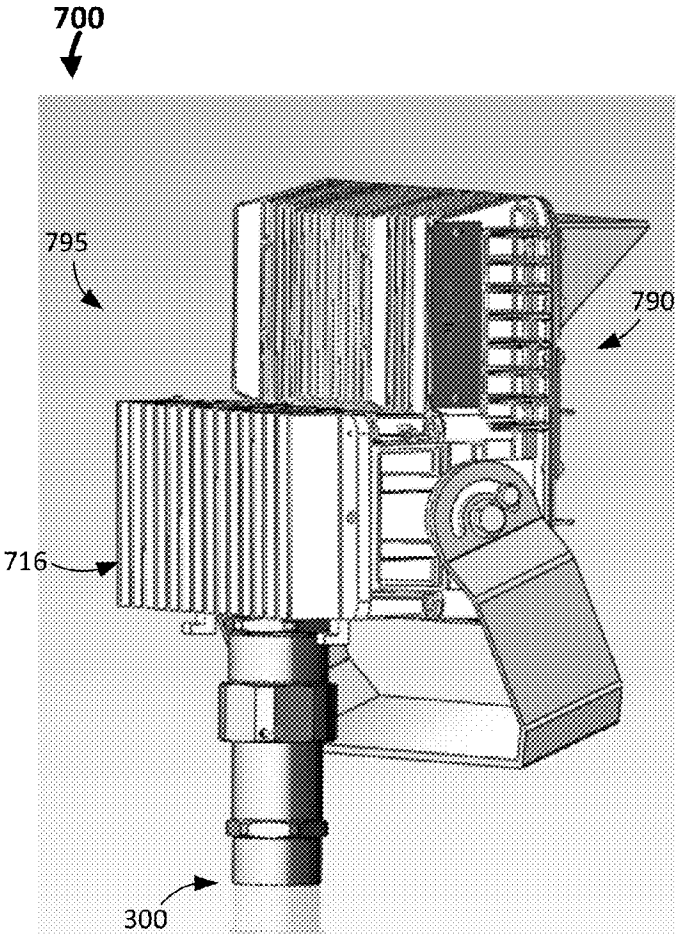
FIG. 7 shows yet another electrical device having a complementary electrical connector end in accordance with certain example embodiments.

FIGS. 5-8 each show a different electrical device having a complementary electrical connector end in accordance with certain example embodiments. Specifically, FIG. 5 shows a flash light 500 having the example complementary electrical connector end 300 described in FIG. 3 above. FIGS. 6A and 6B show various views of a task light 600 having the example complementary electrical connector end 300 described in FIG. 3 above. FIG. 7 shows a flood light 700 having the example complementary electrical connector end 300 described in FIG. 3 above. FIG. 8 shows a temporary light string 800 having the example complementary electrical connector end 400 described in FIG. 4 above. In one or more embodiments, one or more of the components shown in FIG. 5-8 may be omitted, added, repeated, and/or substituted. Accordingly, embodiments of electrical devices having example electrical connector ends should not be considered limited to the specific arrangements of components shown in FIG. 5-8.

If an electrical device includes a light source, the light source can electrically and mechanically couple to one or more of a number of types of socket. Examples of such a socket can include, but are not limited to, an Edison screw base of any diameter (e.g., E26, E12, E14, E39), a bayonet style base, a bi-post base, a bi-pin connector base, a wedge base, and a fluorescent tube base. The light source of the electrical device can electrically and mechanically couple to the socket and can be of a light source type that corresponds to the socket of the electrical device. Examples of light source types of the light source can include, but are not limited to, incandescent lamps, light-emitting diodes (LEDs), halogen lamps, G10/GU10, G9/GU9, AR111/PAR36, T3, MR-11, and MR-16. If the light source of the electrical device is a LED, the LED can be of one or more of a number of types of LED technology, including but not limited to discrete LEDs, LED arrays, chip-on-board LEDs, edge lit LED panels, and surface mounted LEDs.

Referring to FIGS. 1-8, the flash light 500 (an electrical device) of FIG. 5 can have a light source 591 at a distal end 590 and a body 595. In this example, subset 385 of the complementary electrical connector end 300 is used to receive electrical power from subset 135 of the electrical connector end 100. The electrical power delivered to subset 385 of the complementary electrical connector end 300 of the flash light 500 allows the light source 591 to be illuminated, and so is of the proper amount and type of electric power required by the light source 591. In such a case, no driver, transformer, inverter, or other charge transfer device is required to alter the power delivered to subset 385 of the flash light 500. Electrical power can also be delivered to one or more other subsets (e.g., subset 386, subset 387) of the complementary electrical connector end 300 of the flash light 500, but the complementary electrical coupling features of such other subsets are not electrically coupled to anything within the flash light 500.

The task light 600 (another electrical device) of FIGS. 6A and 6B can have a light source 691 at a distal end 690 and a body 695. In this example, the task light 600 requires a different (e.g., greater) amount and/or type of power compared to the amount and type of power required by the flash light 500 of FIG. 5. Accordingly, power delivered through subset 386 of the complementary electrical connector end 300 of the task light 600 from subset 136 of the electrical connector end 100 is used to illuminate the light source 691 of the task light 600. The amount and type of electric power delivered through subset 386 of the complementary electrical connector end 300 of the task light 600 substantially matches the amount and type of power required by the light source 691, and so no charge transfer device is required to alter the power delivered to subset 386 of the task light 600. Electrical power can also be delivered to one or more other subsets (e.g., subset 385, subset 387) of the complementary electrical connector end 300 of the task light 600, but the complementary electrical coupling features of such other subsets are not electrically coupled to anything within the task light 600.

Since the configuration of the complementary electrical coupling features 380, including the subsets, of the complementary electrical connector end 300 are identical for the flash light 500 and the flood light 600, one of these devices can replace the other at the same electrical coupling end 100. The same holds true for any other electrical device (e.g., the flood light 700) having a complementary electrical connector end 300 with the same configuration of the complementary electrical coupling features 380.

The flood light 700 (yet another electrical device) of FIG. 7 can have a light source (hidden from view) at a distal end 790 and a body 795. In this example, the flood light 700 requires a different (e.g., greater) amount and/or type of power compared to the amount and type of power required by the flash light 500 of FIG. 5 and the task light 600 of FIGS. 6A and 6B. Accordingly, power delivered through subset 387 of the complementary electrical connector end 300 of the flood light 700 from subset 137 of the electrical connector end 100 is used to illuminate the light source and/or one or more other components (e.g., a sensor, a controller) of the flood light 700.

The amount and type of electric power delivered through subset 387 of the complementary electrical connector end 300 of the flood light 700 substantially matches the amount and type of power required by the light source and/or one or more other components of the flood light 700, and so no charge transfer device is required to alter the power delivered to subset 387 of the flood light 700. As a result, the housing portion 716 (e.g., a driver housing if the light source of the flood light 700 uses LED-based technology) can be eliminated or used to house some other component of the flood light 700. Electrical power can also be delivered to one or more other subsets (e.g., subset 385, subset 386) of the complementary electrical connector end 300 of the flood light 700, but the complementary electrical coupling features of such other subsets are not electrically coupled to anything within the flood light 700.

The temporary light string 800 (still another electrical device) of FIG. 8 can have one or more lighting devices 890, where each lighting device 890 has one or more light sources 891. Each of the lighting devices 890 is electrically coupled to one or more other lighting devices 890 (in this case, in series) by a cable 892 that connects to a lighting device connector 893. In certain example embodiments, the lighting device connector 893 can be overmolded with the adjacent cables 892 to which the lighting device connector 893 is coupled. The lighting device connector 893 can couple (e.g., fixedly, detachably) to the cable connector 894 disposed at the proximal end of the body 895 of the lighting device 890.

The cable 892 at one end of the temporary light string 800 can have the complementary electrical connector end 400 for coupling to the electrical connector end 200. At the opposite end of the temporary light string 800 can be another cable 892 with its own electrical connector end 200. In such a case, the electrical connector end 200 of the temporary light string 800 can be used to couple to another electrical device (e.g., flash light, task light, flood light, temporary light string).

In this example, the subsets of the complementary electrical connector end 400 of the temporary light string 800 can be used to provide power for various lighting devices 890 along the temporary light string 800. For example, each subset can represent a zone (e.g., a length) of the temporary light string 800. In such a case, subset 485 of the complementary electrical connector end 400 of the temporary light string 800 can be used to provide power to any lighting devices 890 coupled to a number (e.g., one, three) of lighting device connectors 893 located closest to the complementary electrical connector end 400 of the temporary light string 800. Similarly, subset 488 of the complementary electrical connector end 400 of the temporary light string 800 can be used to provide power to any lighting devices 890 coupled to another number (e.g., two, six, nine) of lighting device connectors 893 located closest to the complementary electrical connector end 400 of the temporary light string 800.

Finally, subset 489 of the complementary electrical connector end 400 of the temporary light string 800 can be used to provide power to some other number (e.g., all) of lighting devices 890 coupled to the lighting device connectors 893 of the temporary light string 800. As another example, the complementary electrical connector end 400 of the temporary light string 800 can have ten subsets, where each subset independently provides power to one of ten lighting devices 890 of the temporary light string 800.

In any case, one or more subsets of the complementary electrical connector end 400 of the temporary light string 800 can provide power to the electrical connector end 200 of the temporary light string 800, which in turn can be coupled to another electrical device. Thus, power delivered through one or more subsets (e.g., subset 485, subset 488, subset 489) of the complementary electrical connector end 400 of the temporary light string 800 from a corresponding subset (e.g., subset 235, subset 238, subset 239) of the electrical connector end 200 can be used to illuminate the lighting devices 890 of the temporary light string 800 and/or one or more other electrical devices coupled to the electrical connector end 200 of the temporary light string 800.

The amount and type of electric power delivered through subsets of the complementary electrical connector end 400 of the temporary light string 800 substantially matches the amount and type of power required by the lighting devices 890 of the temporary light string 800 and/or one or more other electrical devices coupled to the electrical connector end 200 of the temporary light string 800. As a result, no charge transfer device is required to alter the power delivered to the lighting devices 890 of the temporary light string 800 and/or one or more other electrical devices coupled to the electrical connector end 200 of the temporary light string 800. Electrical power can also be delivered to one or more other subsets of the complementary electrical connector end 400 of the temporary light string 800, but the complementary electrical coupling features of such other subsets are not electrically coupled to anything within the temporary light string 800.

The systems and methods described herein may provide several advantages including a significant savings in time and material for installing, modifying, and/or maintaining a system where a variety of electrical devices, each having unique power requirements, are powered from a central location. For example, a user can quickly change from a flash light to a task light while working in a particular area. Any electrical devices using example multi-pin connectors can be used in any of a number of hazardous locations while complying with applicable standards for such hazardous location.

Further, the weight, cost, and complexity of electrical devices used with example multi-pin connectors can be greatly reduced relative to electrical devices currently in use. For example, a floodlight using an example multi-pin connector can weigh significantly less than an existing floodlight, making maneuverability of the floodlight by a user much easier, because the floodlight does not have a driver or equivalent power source. Further, example embodiments use a common driver or equivalent power source, not located in the hazardous environment where the electrical devices are used, to provide power to all electrical devices. Thus, example embodiments eliminate the need for running special power feeds for each electrical device. Thus, example embodiments provide a number of benefits, including but are not limited to use of fewer materials, reuse of electrical devices, simplified installation and use, simplified maintenance using example embodiments, and reduced cost.

In addition, using example embodiments allow for compliance with one or more of a number of standards that require an enclosure and/or electrical device to have a flame path. As a result, such an enclosure and/or electrical device can be flame-proof, explosion-proof, and/or have any other suitable designation required for one or more of a number of hazardous environments.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A system, comprising:

a first electrical connector end comprising a plurality of electrical coupling features, wherein the plurality of electrical coupling features comprises a first subset of electrical coupling features and a second subset of electrical coupling features; and a first electrical device comprising a second electrical connector end detachably coupled to the first electrical connector end, wherein the second electrical connector end comprises a plurality of complementary electrical coupling features coupled to the plurality of electrical coupling features of the first electrical connector end, wherein the first subset of electrical coupling features provides a first power signal to a first subset of complementary electrical coupling features of the second electrical connector end, wherein the second subset of electrical coupling features provides a second power signal to a second subset of complementary electrical coupling features of the second electrical connector end, wherein the first subset of complementary electrical coupling features of the second electrical connector end allows the first power signal to pass therethrough, and wherein the second subset of complementary electrical coupling features of the second electrical connector end prevents the second power signal from passing therethrough.

2. The system of claim 1, further comprising:

a second electrical device replacing the first electrical device, wherein the second electrical device comprises a third electrical connector end detachably coupled to the first electrical connector end, wherein the third electrical connector end comprises the plurality of complementary electrical coupling features coupled to the plurality of electrical coupling features of the first electrical connector end, wherein the plurality of complementary electrical coupling features comprises the first subset of complementary electrical coupling features and the second subset of complementary electrical coupling features, wherein the second subset of complementary electrical coupling features that of the third connector end allows the second power signal provided by the first electrical connector end to pass therethrough, and wherein the first subset of complementary electrical coupling features of the third electrical connector end prevents the first power signal provided by the first electrical connector end from passing therethrough.

3. The system of claim 1, wherein the first power signal provides power to operate the first power electrical device.

4. The system of claim 3, wherein the first power signal is provided by a first power source, and wherein the second power signal is provided by a second power source.

5. The system of claim 1, wherein the first electrical connector end and the first electrical device are rated for use in a hazardous environment.

6. The system of claim 5, wherein the first electrical connector end further comprises a first shell inside of which the first plurality of electrical coupling features are disposed, wherein the second electrical connector end further comprises a second shell inside of which the second plurality of electrical coupling features are disposed, and wherein the first shell couples to the second shell.

7. The system of claim 6, wherein the first shell and the second shell, when coupled to each other, form a flame path.

8. The system of claim 1, wherein the first subset of electrical coupling features and the second subset of electrical coupling features comprise no common electrical coupling features.

9. The system of claim 1, wherein the first subset of electrical coupling features and the second subset of electrical coupling features comprise at least one common electrical coupling features.

10. The system of claim 9, wherein the at least one common electrical coupling feature is for an electrical ground.

11. The system of claim 1, wherein the plurality of complementary electrical coupling features has an orientation that couples to the plurality of electrical coupling features only when the second electrical connector end is in a position relative to the first electrical connector end.

12. The system of claim 1, wherein the first subset of complementary electrical coupling features of the second electrical connector end comprises fewer electrical coupling features compared to the second subset of complementary electrical coupling features of the second electrical connector end.

13. The system of claim 1, wherein the first electrical device further comprises a third electrical connector end that is substantially similar to the first electrical connector end.

14. An electrical connector end comprising a plurality of electrical coupling features, wherein the plurality of electrical coupling features comprise:

a first subset of electrical coupling features configured to deliver a first power signal to a first subset of complementary electrical coupling features of a first complementary electrical connector end, wherein the first complementary electrical connector end comprises a first plurality of complementary electrical coupling features that couple to the plurality of electrical coupling features, wherein the first plurality of complementary electrical coupling features comprises the first subset of complementary electrical coupling features; and a second subset of electrical coupling features configured to deliver a second power signal to a second subset of complementary electrical coupling features of a second complementary electrical connector end, wherein the second complementary electrical connector end comprises a second plurality of complementary electrical coupling features that couple to the plurality of electrical coupling features, wherein the second plurality of complementary electrical coupling features comprises the second subset of complementary electrical coupling features, wherein the first complementary electrical connector end allows the first power signal to pass therethrough and prevents the second power signal from passing therethrough, wherein the second complementary electrical connector end allows the second power signal to pass therethrough and prevents the first power signal from passing therethrough.

15. The electrical connector end of claim 14, further comprising:

a third subset of electrical coupling features configured to deliver a third power signal to a third subset of complementary electrical coupling features of a third complementary electrical connector end, wherein the third complementary electrical connector end comprises a third plurality of complementary electrical coupling features that couple to the plurality of electrical coupling features, wherein the third plurality of complementary electrical coupling features comprises the third subset of complementary electrical coupling features, wherein the third complementary electrical connector end allows the third power signal to pass therethrough and prevents the first power signal and the second power signal from passing therethrough.

16. The electrical connector end of claim 14, wherein the first subset of electrical coupling features and the second subset of electrical coupling features comprise at least one common electrical coupling feature and at least one uncommon electrical coupling feature.

17. The electrical connector end of claim 14, wherein the first subset of electrical coupling features and the second subset of electrical coupling features comprise no common electrical coupling feature.

18. An electrical connector, comprising:

a first electrical connector end comprising a plurality of electrical coupling features, wherein the plurality of electrical coupling features comprises a first subset of electrical coupling features and a second subset of electrical coupling features; and a second electrical connector end detachably coupled to the first connector end, wherein the second electrical connector end comprises a first subset of complementary electrical coupling features and a second subset of complementary electrical coupling features, wherein the first subset of complementary electrical coupling features are coupled to the first subset of electrical coupling features of the first electrical connector end, and wherein the second subset of complementary electrical coupling features are coupled to the second subset of electrical coupling features of the first electrical connector end, wherein the first subset of electrical coupling features provides a first power signal to the first subset of complementary electrical coupling features of the second electrical connector end, wherein the second subset of electrical coupling features provides a second power signal to the second subset of complementary electrical coupling features, wherein the first subset of complementary electrical coupling features of the second electrical connector end allows the first power signal to pass therethrough, and wherein the second subset of complementary electrical coupling features of the second electrical connector end prevents the second power signal from passing therethrough.

19. The electrical connector of claim 18, further comprising:

a third electrical connector end replacing the second electrical connector end and detachably coupled to the first electrical connector end, wherein the third electrical connector end comprises the plurality of complementary electrical coupling features coupled to the plurality of electrical coupling features of the first electrical connector end, wherein the plurality of complementary electrical coupling features comprises the first subset of complementary electrical coupling features and the second subset of complementary electrical coupling features, wherein the second subset of complementary electrical coupling features of the third electrical connector end allows the second power signal to pass therethrough, and wherein the first subset of complementary electrical coupling features of the third electrical connector end prevents the first power signal from passing therethrough.

20. The electrical connector of claim 19, wherein the second electrical connector end is part of a first electrical device, and wherein the third electrical connector end is part of a second electrical device.

* * * * *